US005193870A

United States Patent [19]

MacInnis et al.

[11] Patent Number: 5,193,870

[45] Date of Patent: Mar. 16, 1993

[54] DEVICE FOR SANITARY HANDLING AND DISPOSAL OF PET DROPPINGS

[76] Inventors: Irene MacInnis, 3030 Steiner, Santa Monica, Calif. 90405; Richard M. Lienau; Bonnie L. Lienau, both of 1236 Wellesley Ave., #1, Los Angeles, Calif. 90025

[21] Appl. No.: 832,705

[22] Filed: Feb. 7, 1992

[51] Int. Cl.[5] ..... A01K 29/00; E01H 1/12

[52] U.S. Cl. ..... 294/1.4

[58] Field of Search ..... 294/1.3-1.5, 294/11, 19.1, 22, 34, 50, 50.9, 55, 103.1; 15/104.8, 257.1, 257.4, 257.6, 257.7

[56] References Cited

U.S. PATENT DOCUMENTS

| | | | |
|---|---|---|---|
| 2,317,688 | 4/1943 | McDonald | 294/55 X |
| 3,052,214 | 9/1962 | Johnson | 294/1.4 |
| 3,560,039 | 2/1971 | Gruber | 294/1.3 |
| 3,984,139 | 10/1976 | Battaglia | 294/1.4 |
| 4,003,595 | 1/1977 | Fano et al. | 294/1.5 |
| 4,014,584 | 3/1977 | Bau | 294/1.4 |
| 4,201,409 | 5/1980 | O'Hara | 294/1.4 |
| 4,215,887 | 8/1980 | Boots | 294/1.4 |
| 4,231,602 | 11/1980 | Kinney | 294/1.4 |
| 4,529,236 | 7/1985 | Vogt | 294/1.3 |

FOREIGN PATENT DOCUMENTS

| | | | |
|---|---|---|---|
| 8702192 | 4/1989 | Netherlands | 294/1.3 |
| 448823 | 6/1936 | United Kingdom | 294/1.3 |

*Primary Examiner*—Johnny D. Cherry
*Attorney, Agent, or Firm*—Beehler & Pavitt

[57] ABSTRACT

A device for sanitary disposal of pet droppings lying on a ground surface. The device allows sanitary packaging of the droppings in a plain sheet of paper or plastic placed over the droppings. The device has a wire catch fixed to one end of a first handle, a rod slidable through the handle, a second handle fixed to one end of the rod, and a wire loop attached to an opposite end of the rod. The loop is placed over the sheet around the droppings and the handles are pulled apart to gather and close the sheet around the droppings. The resulting package is retained by the device for transport and disposal at an appropriate site.

8 Claims, 2 Drawing Sheets

DEVICE FOR SANITARY HANDLING AND DISPOSAL OF PET DROPPINGS

BACKGROUND OF THE INVENTION

1. Field of the Invention

This invention relates to the field of hand-held devices and aids for the sanitary handling and disposal of solid waste and droppings left by household pet animals, particularly canine droppings.

2. State of the Prior Art

Many municipalities have enacted ordinances obligating pet owners to promptly remove solid excrement left by their pet animals, notably dogs, on sidewalks and similar public areas. These laws, popularly known as "pooper-scooper" laws, have spurred considerable creative activity in the design of waste retrieval and handling devices which would allow pet owners to comply with the law with minimum distaste. Many such devices are now in use, and while most of these adequately perform their intended function, further improvement is still desirable.

Some of the existing devices for removal of animal droppings are deficient in that the device itself must come into contact with the waste material and becomes contaminated and unsanitary. Efforts to avoid this problem have led to various designs which interpose a disposable bag or wrapper between the handling device and the waste. These devices, however, require the user to fit a fresh bag on the device prior to each use. In some cases, bags specially designed for use with the particular device are required.

A continuing need therefore exists for pet waste retrieval and disposal devices which are entirely sanitary, do not require use of special disposal bags, and which in particular do not require the user to insert or attach a fresh bag on the retrieval device prior to each use. Many of the prior art devices are needlessly complex and bulky, and the improved device should therefore be simple, light weight and compact so that it can be comfortably and unobtrusively carried along while walking a pet.

SUMMARY OF THE INVENTION

The waste disposal device of this invention improves over the prior art in that solid pet waste can be wrapped in a sheet which is simply placed over the waste material. The wrapper sheet need not be of any particular material, size or shape. It is only necessary that the sheet be oversized in relation to the lump of waste, so that portions of the sheet extend around the waste material.

The waste disposal device is applied to the sheet covering the waste and is then actuated by the user to wrap the sheet around the waste material. The disposal device retains hold of the sheet so that the now packaged waste can be picked-up and moved to a disposal location, where the package can be released and dropped from the retrieval device. The disposal device makes contact only with the top side of the sheet which is free of the waste material and thus avoids any unsanitary contact with and contamination by the waste material.

More specifically, the device of this invention is generally elongated, with a handle assembly which includes two tubular handles mounted end-to-end on a rod. One handle is fixed to the rod while the other handle is free to slide on the rod. The end of the rod opposite the fixed handle supports a flat loop made, for example, of heavy gauge wire. The preferred loop is rectangular and has one corner fixed to the end of the rod so that a diagonal of the loop is aligned with the rod.

The slidable handle supports a catch element, which in a presently preferred form is a V-shaped length of wire with the point of the V oriented towards the sliding handle. The catch element is parallel to and closely adjacent to the plane of the loop.

In an initial, extended condition of the device the sliding handle is adjacent to the fixed handle and the loop extends beyond the catch. The loop is placed around the mound of waste, pressing the sheet firmly against the ground surface along a perimeter encompassing the waste. The user then pulls on the fixed handle, which draws the rod through the sliding handle and pulls the loop under the catch. As the loop is retracted from its extended position, the catch element on the sliding handle sweeps above and across the area encompassed by the loop, gathering together the folds of the sheet which pass through the loop to form a sac around the waste material. The loop and the catch operate in the manner of the draw string in a purse bag to draw the sheet closed under the waste material and to hold the sheet closed in a retracted condition of the device.

The waste material can be conveniently and sanitarily carried, wrapped in the sheet at the end of the device, as long as the device is kept in its retracted condition. The packaged waste is released at a suitable disposal site simply by moving the handles together so as to advance the loop towards its extended position.

DETAILED DESCRIPTION OF THE PREFERRED EMBODIMENT

Figures 1, 2, 2A:
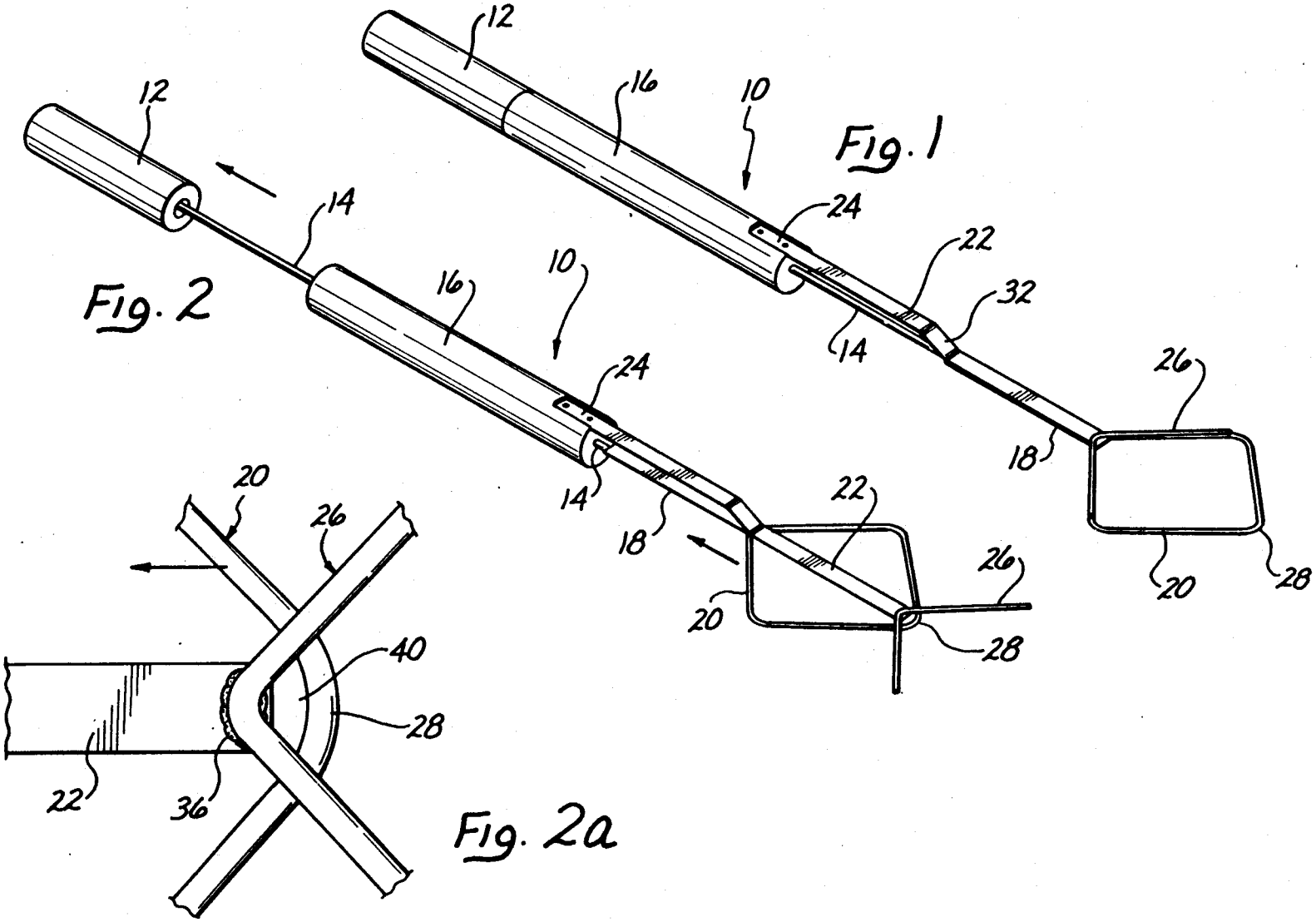
FIG. 1 is a perspective view of the waste disposal device shown in its extended condition.
FIG. 2 is a view as in FIG. 1 showing the device in its retracted condition.
FIG. 2a is a fragmentary plan view of the device in FIG. 2 showing the small aperture defined between the loop and the catch element for capturing the cover sheet in the retracted condition of the device.
Figure 5:
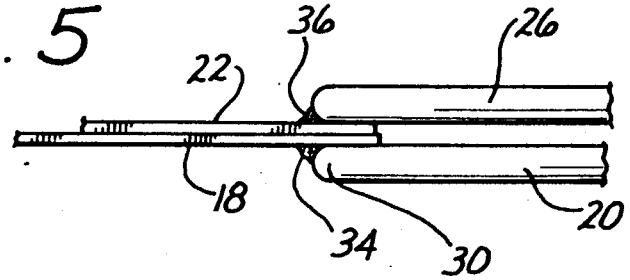
FIG. 5 is a fragmentary side view enlarged to show the manner of attaching the catch element and loop element to corresponding flexible blades which slide against each other while in a flexed state to allow retraction from the condition of FIG. 3 to that illustrated in FIG. 4.

With reference to the drawings, FIG. 1 shows the waste disposal device generally indicated by numeral 10, which has a first handle 12 fixed to one end of a rod 14, and a second handle 16 slidable on the rod. A spring blade 18 is welded to the opposite end of the rod 14 and supports a rectangular loop 20. The loop 20 has a corner 30 welded to the end of the blade 18, such that a diagonal of the loop is aligned with both the spring blade 18 and rod 14. A second spring blade 22 has one end 24 fixed to the second handle 16, and has an opposite end which supports a catch 26. The catch is a V shaped wire bent to a right angle, with the point of the V fixed to the spring blade 22. The interior of the V is oriented away from the handles and towards the end corner 28 of the loop 20. The catch 26 is sized such that it spans the width of the loop 20 and overlaps a similar V shape formed by the two sides of the loop 20 which are connected to the spring blade 18, as seen in FIG. 1. The blade 22 is bent at 32 so as to bring the catch 26 into close proximity with the loop 20. The attachment of the loop 20 and catch 26 to their respective supporting spring blades 18, 22 is best understood by reference to FIG. 5. The loop 20 and catch 26 are fixed by welds 34, 36 to the corresponding blades 18, 22. The two spring blades slide against each other in the region between the bend 32 and the loop 20, and support the loop and catch 26 in mutually parallel relationship and in close spacing to each other. The disposal device 10 is operated by pulling the first handle 12 away from the second handle 16, moving the loop 20 from the extended position of FIG. 1 to the retracted position of FIG. 2 along the direction indicated by the arrows in FIG. 2.

Figure 3:
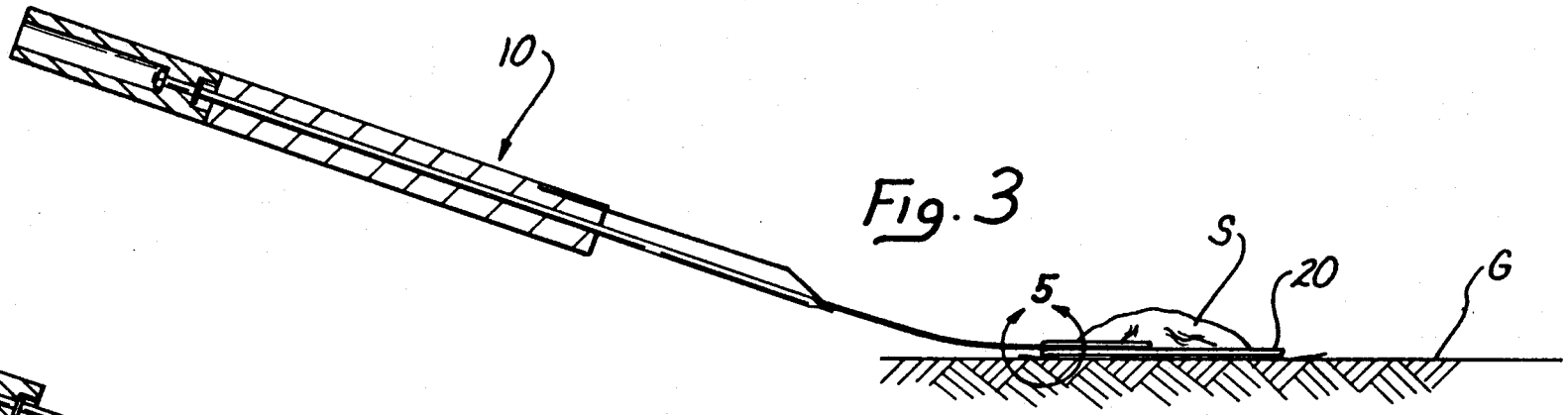
FIG. 3 is a side view, partly in cross section, showing the extended device being applied to a sheet covering a mound of waste.
Figure 4:
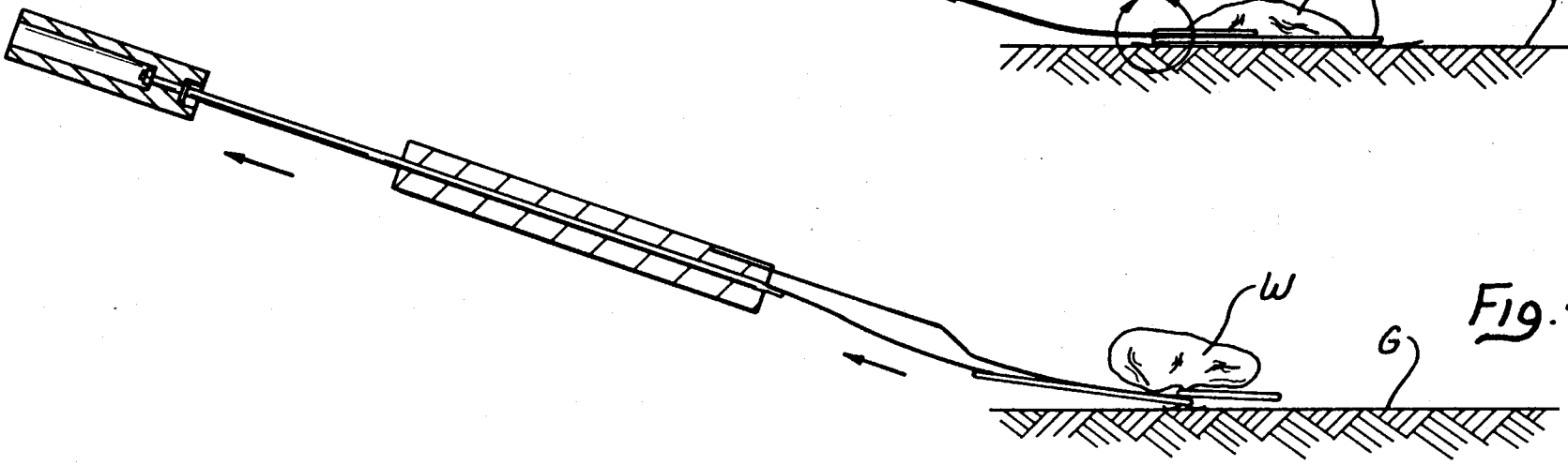
FIG. 4 is a view as in FIG. 3 showing the retrieval device retracted to wrap the sheet around the waste material for sanitary disposal.

The use of the device to retrieve waste material from a ground surface will now be described with reference to FIGS. 3 and 4. The waste material is first covered with a sheet S of any suitable preferably impermeable material, such as plastic sheet material. The cover sheet S should be sufficiently large to cover the pile of waste material with substantial edge portions extending around the waste material. The device 10 is advanced to the extended condition of FIG. 1 and the loop 20 is laid flat over the cover sheet S and around the pile of covered waste. The loop is pressed down firmly against the ground surface G, holding the sheet S along the length of the loop 20, as illustrated in FIG. 3. At this point, the plane of the loop cuts across the base of the mound formed by the cover sheet S on the pile of waste. In other words, the cover sheet S crosses the plane of the loop 20, rising from the ground surface outside the loop to the top of the pile of waste inside the loop. The user bears down on the handles 12, 16 flexing somewhat the spring blades 22, 18 as shown in FIG. 3, so that the loop 20 presses the sheet S firmly against the ground surface G. The user then pulls the handle 12 away from the handle 16, pulling the loop underneath the catch 26 to the retracted position of FIG. 4. The loop 20 pulls the covered pile of waste up against the inside of the catch 26, at which point the mound of waste is stopped by the catch, while the loop 20 continues its movement underneath the lump of waste. As the catch 26 sweeps over the loop towards the end corner 28, the sheet is gathered together along the direction of the rod 14 and also transversely thereto, between the catch and the end corner and is drawn closed under the waste material W. The sheet S forms a sac which is clamped closed between the corner 30 of the catch 26 and the end corner 28 of the loop 20, in a small opening 40 best seen in FIG. 2*a*. The catch 26 and the loop 20 hold the sheet S as long as the device 10 remains in the retracted position, so that the packaged waste W in FIG. 4 can be held at a comfortable distance from the user, at the end of the device 10, while it is picked-up from the ground surface and taken to a suitable disposal site. The wrapped waste can be dropped by simply turning over the device 10 and pushing the handle 12 towards the handle 16, which separates the corners 30, 28 in FIG. 2*a*, releasing the cover sheet S together with the waste contained therein.

The device 10 is simple to construct, light weight, has a minimum of moving parts, and is dependable in use. No special bags are required and almost any sheet material S can be used with the device 10, making its use convenient and economical. Furthermore, sheet material which might be discarded can be reused for this purpose, such as plastic grocery bags. The waste disposal device 10 is furthermore entirely clean and sanitary in use in that the loop 20 and catch 26 make contact only with the top side of the sheet S which does not touch the waste material under the sheet. As the device is retracted around the covered waste, the sheet S protects the loop and the catch from contact with the waste material.

While a particular embodiment of the invention has been described and illustrated for purposes of clarity and example, it must be understood that many changes, substitutions and modifications to the described embodiment will become obvious to those possessed of ordinary skill in the art without thereby departing from the scope and spirit of the present invention which is defined by the following claims.

What is claimed is:

1. A device for wrapping pet droppings lying on a ground surface in a sheet previously placed over the droppings with sheet portions surrounding the droppings, comprising:

handle means, a loop element and a catch element supported on said handle means, said loop and catch elements each maintaining a planar configuration independently of the other, said handle means being actuable for linearly displacing said loop and catch elements relative to each other in mutually parallel closely adjacent relationship along a direction parallel to said elements, said loop element adapted to press the surrounding sheet portions against the underlying surface around the droppings, said loop and catch elements cooperating responsive to actuation of said handle means for gathering the sheet around and under said droppings along said direction and also transversely thereto, thereby wrapping the droppings in the sheet and retaining the sheet to the handle means for sanitary disposal.

2. The device of claim 1 wherein said handle means comprise a first handle attached to said loop element and a second handle attached to said catch element, said handles being assembled for axial movement relative to each other.

3. A device actuatable for wrapping pet droppings lying on a ground surface in a sheet placed over the droppings, comprising:

a loop and a catch supported on handle means and movable relative to each other from an extended position, wherein said loop may be placed around the droppings for pressing the sheet against the ground surface, towards a retracted position wherein portions of the sheet passing through the loop are drawn together between said loop and said catch to make a sanitary wrapper around the droppings, said portions of the sheet being retained for pick-up with said handle means, said sheet being releasable for disposal with the droppings by returning said loop and catch towards said extended position;

wherein said handle means comprise a first handle attached to one end of a rod and said loop to an opposite end of said rod, and a second handle slidable on said rod for moving said catch between said extended and retracted positions, and said loop is rectangular and is attached to said handle means at a corner thereof with a diagonal of the loop aligned with said rod.

4. The device of claim 3 wherein said loop is planar, and said catch spans the width of said loop.

5. The device of claim 3 wherein said catch is a length of wire bent to form a corner, said catch being attached to said handle means at said corner with the interior of the corner facing away from said handle means.

6. The device of claim 3 wherein said catch is a wire bent to form a V-shaped, the point of the V being attached to said handle means and the inside of the V oriented away from said handle means.

7. The device actuatable for wrapping pet droppings lying on a ground surface in a sheet placed over the droppings, comprising:

a loop and a catch supported on handle means and movable relative to each other from an extended position, wherein said loop may be placed around the droppings for pressing the sheet against the ground surface, towards a retracted position wherein portions of the sheet passing through the loop are drawn together between said loop and said catch to make a sanitary wrapper around the droppings, said portions of the sheet being retained for pick-up with said handle means, said sheet being releasable for disposal with the droppings by returning said loop and catch towards said extended position;

wherein said loop and said catch are each attached to said handle means by a corresponding flexible spring blade.

8. A device actuatable for wrapping pet droppings lying on a ground surface in an unformed sheet of pliable material placed over the droppings, comprising:

a catch element fixed to one end of a first handle, a rod slidable through said handle, a second handle fixed to one end of said rod, and a loop attached to an opposite end of said rod, said loop and said catch element being planar elements of substantially rigid self-supporting shape and disposed in mutually parallel closely adjacent relationship in a plane parallel to said rod, said loop and said catch element cooperating responsive to relative movement of said first and second handles for gathering the sheet around and under said droppings along a direction aligned with said rod and also transversely thereto thereby wrapping the droppings in the sheet and retaining the sheet between said loop and said catch element for sanitary disposal.

* * * * *